US008591191B1

(12) United States Patent
Liang

(10) Patent No.: US 8,591,191 B1
(45) Date of Patent: Nov. 26, 2013

(54) FILM COOLING HOLE FOR TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 560 days.

(21) Appl. No.: 12/951,568

(22) Filed: Nov. 22, 2010

(51) Int. Cl.
*F01D 5/08* (2006.01)

(52) U.S. Cl.
USPC ..... 416/97 R; 416/97 A; 416/96 R; 415/115; 29/889.7; 29/889.72; 29/889.722

(58) Field of Classification Search
USPC ..... 415/115, 116; 416/95, 96 R, 96 A, 97 R, 416/97 A; 29/889.7, 889.72, 889.722
See application file for complete search history.

(56) References Cited

U.S. PATENT DOCUMENTS

| | | | | |
|---|---|---|---|---|
| 4,705,455 | A * | 11/1987 | Sahm et al. | 416/97 R |
| 4,992,025 | A * | 2/1991 | Stroud et al. | 416/97 R |
| 5,313,038 | A * | 5/1994 | Kildea | 219/69.17 |
| 5,382,133 | A * | 1/1995 | Moore et al. | 415/115 |
| 6,368,060 | B1 * | 4/2002 | Fehrenbach et al. | 416/97 R |
| 7,262,382 | B2 * | 8/2007 | Beaumont et al. | 219/69.15 |
| 2004/0265488 | A1 * | 12/2004 | Hardwicke et al. | 427/180 |
| 2008/0286090 | A1 * | 11/2008 | Okita | 415/115 |

* cited by examiner

*Primary Examiner* — Igor Kershteyn
(74) *Attorney, Agent, or Firm* — John Ryznic

(57) ABSTRACT

A film cooling hole for a turbine airfoil having a diffusion section with a convergent wall and two divergent side walls, and with a thin exit slot that opens onto the airfoil surface. The divergent side walls have an expansion of 15 to 25 degrees and the convergent wall converges up to 15 degrees. The film hole is formed by an electrode than is pushed into the metal surface to form the divergent side walls and then pivoted to form the convergent wall.

8 Claims, 7 Drawing Sheets

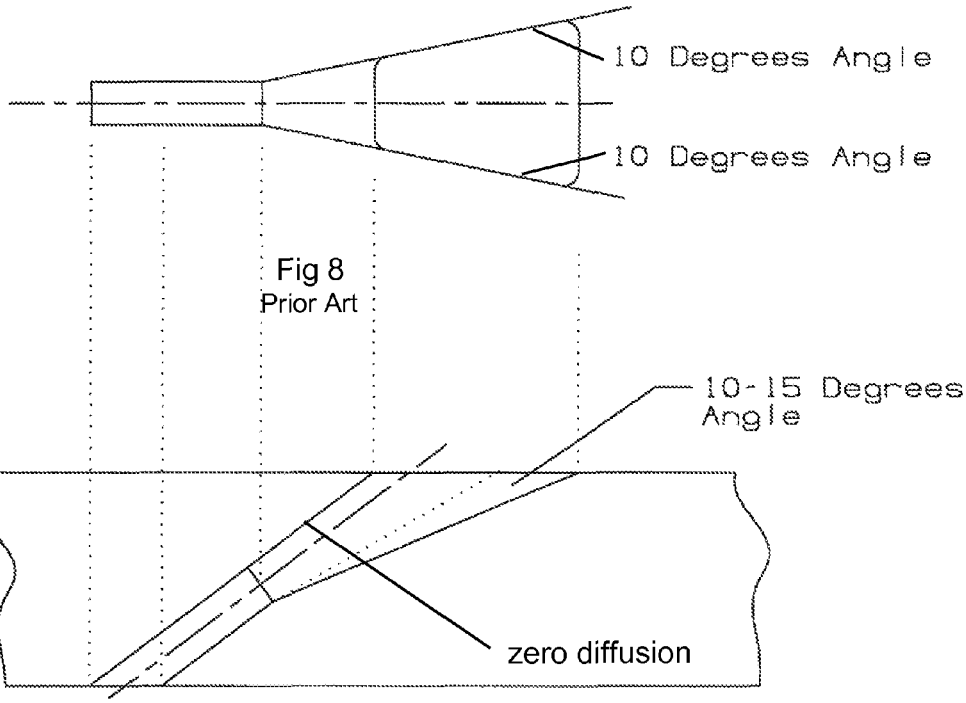
Fig 8
Prior Art
Fig 9
Prior Art
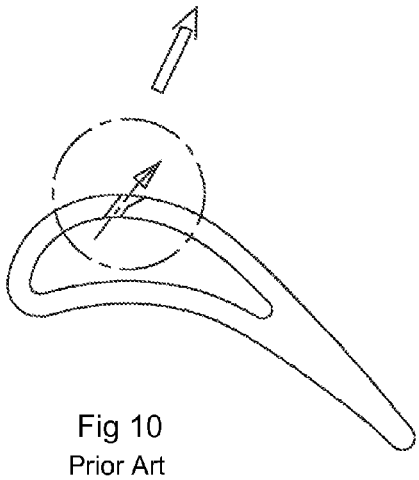
Fig 10
Prior Art

FILM COOLING HOLE FOR TURBINE AIRFOIL

GOVERNMENT LICENSE RIGHTS

None.

CROSS-REFERENCE TO RELATED APPLICATIONS

None.

BACKGROUND OF THE INVENTION

1. Field of the Invention

The present invention relates generally to gas turbine engine, and more specifically to a film cooling hole for a turbine airfoil.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream in a progressively decreasing temperature. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Turbine airfoils (which include rotor blades and stator vanes) include film cooling holes to discharge a layer of film cooling air over a surface of the airfoil to form a blanket of cool air against the hot gas stream that flows over the surface. In one prior art film cooling hole, the film hole passes straight through the airfoil wall at a constant diameter and exits at an angle to the surface. Some of the cooling air is ejected directly into the mainstream gas flow causing turbulence, coolant dilution and a loss of downstream film effectiveness. Also, the hole breakout in the streamwise elliptical shape will induce stress in a blade application. FIGS. 1 through 7 shows varies views of the straight film cooling hole with constant diameter.

FIGS. 8 through 10 show another prior art film cooling that includes a diffusion section. This film hole includes a 10×10×10 streamwise three dimension diffusion hole. This film hole includes a constant cross section flow area at an inlet end for metering the cooling air flow and a diffusion section downstream. The diffusion section includes three walls each having 10 degrees of slant. The upstream wall of the film hole (the left side in FIG. 9) has zero diffusion and is parallel to the film hole axis. In this film hole, hot gas from the mainstream flow frequently gets entrained into the upper corner and causes shear mixing with the cooling air (see FIG. 11 reference numeral 12). This results in a reduction of film cooling effectiveness for the film cooling hole. Also, internal flow separation occurs (FIG. 11 reference numeral 11) within the diffusion hole at a junction between the constant cross section area and the diffusion region.

BRIEF SUMMARY OF THE INVENTION

A turbine airfoil with a film cooling hole that has both a divergent shape and a convergent shape diffusion section. The film cooling hole includes a parallel flow section at an inlet followed by a diffusion section that is divergent on the two side walls and convergent on the downstream side wall or upstream side wall. A thin exit slot opens onto the airfoil surface that has a width much greater than the opening length in the streamwise flow direction.

An electrode is used to form the film hole and includes an electrode holder, a diffusion forming section extending from the holder, and a parallel section that forms the film hole inlet section. To form the film hole, the electrode is pushed into the metal surface to the desired length, and then the electrode is pivoted to form the convergent wall. The electrode is then removed from the metal surface to leave the film cooling hole.

BRIEF DESCRIPTION OF THE SEVERAL VIEWS OF THE DRAWINGS

FIGS. 8 through 10 shows various views of a prior art film cooling hole having a diffusion section.

FIG. 17 shows a side view of the electrode within the hole that pivots to form the divergent portion of the film hole.

DETAILED DESCRIPTION OF THE INVENTION

Figure 12:
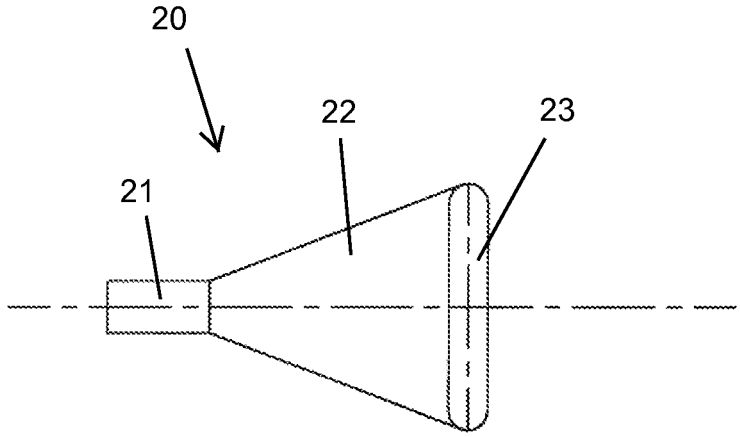
FIG. 12 shows a cross section top view of the divergent and convergent film cooling hole of the present invention.
Figure 13:
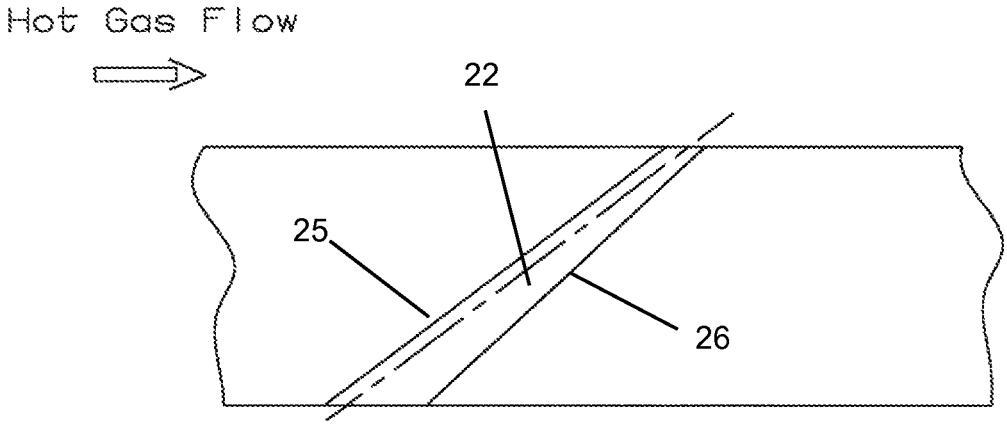
FIG. 13 shows a cross section side view of the film cooling hole of FIG. 12.

A film cooling hole for use in a turbine stator vane or rotor blade to produce a layer of film cooling air on a hot gas surface of the part. The film cooling hole is formed by an electrode that is pushed into the metal surface and then slightly pivoted to form the convergent section of the film hole. FIG. 12 shows a convergent and divergent film cooling hole 20 of the present invention that includes a parallel inlet section 21 and divergent and convergent section 22 and a thin exit slot 23 that opens onto the surface. FIG. 13 shows a side view of the film cooling hole 20. As seen in FIG. 12, the two side walls are divergent in the direction of the cooling air flow with an angle of around 15 degrees to 25 degrees from the axis of the film hole. FIG. 13 shows the film hole convergent section which decreases in height in the direction of the cooling air flow. In the FIG. 13 embodiment, the upstream wall 25 of the film hole is parallel to the film hole axis and has zero expansion. The downstream wall 26 is slanted at an angle up to 15 degrees to form the convergent section.

Figure 14:
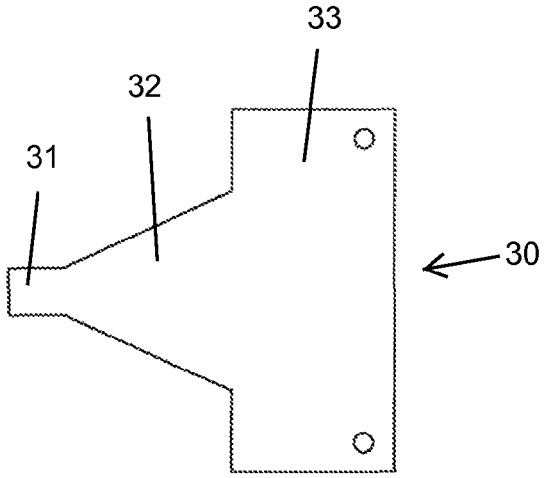
FIGS. 14 through 17 shows various views of the electrodes that are used to form the film cooling hole of the present invention.
Figure 15:
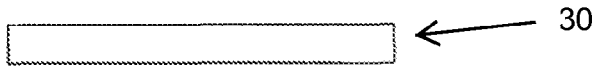
Figure 16:
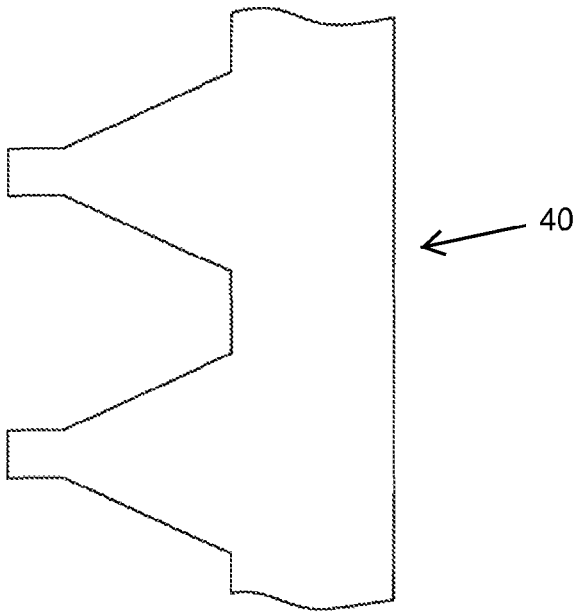

FIG. 14 shows a top view of the electrode 30 used to form the divergent and convergent film cooling hole 20. The electrode 30 includes an electrode holder 33 with a convergent and divergent section forming piece 32 extending from the holder 33, and a parallel section piece 31 extending from the piece 32. FIG. 15 shows a side view of the electrode 30 that has a constant thickness. FIG. 16 shows an embodiment of an electrode 40 that can form more than one film hole at a time.

Figure 17:
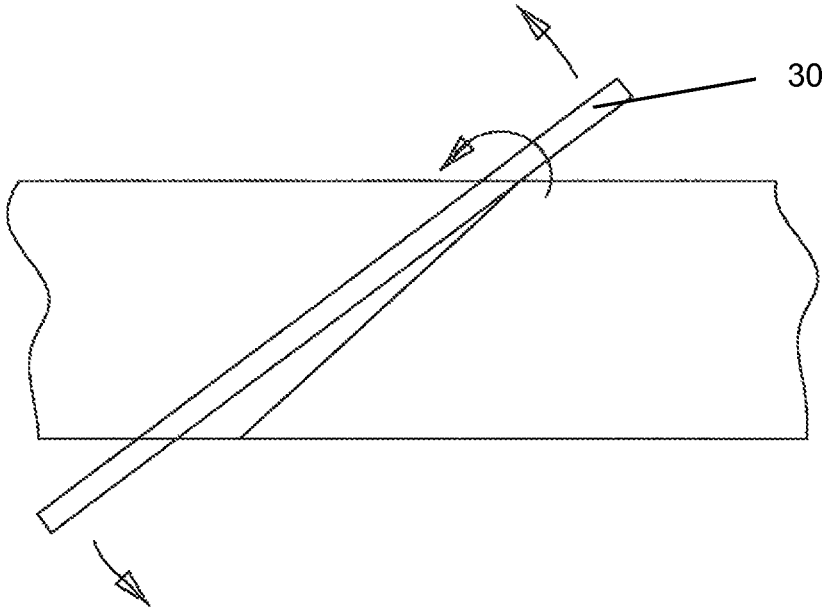
Figure 18:
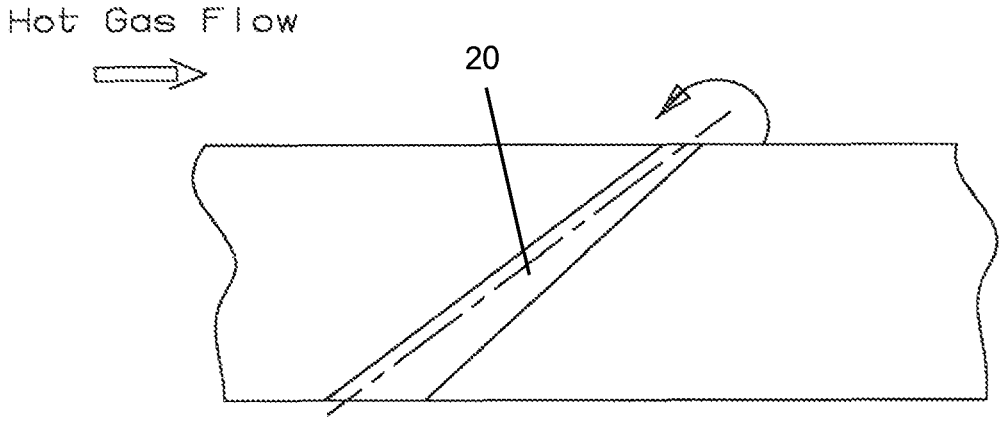
FIG. 18 shows a divergent and convergent film hole of the present invention with the downstream wall slanted.
Figure 19:
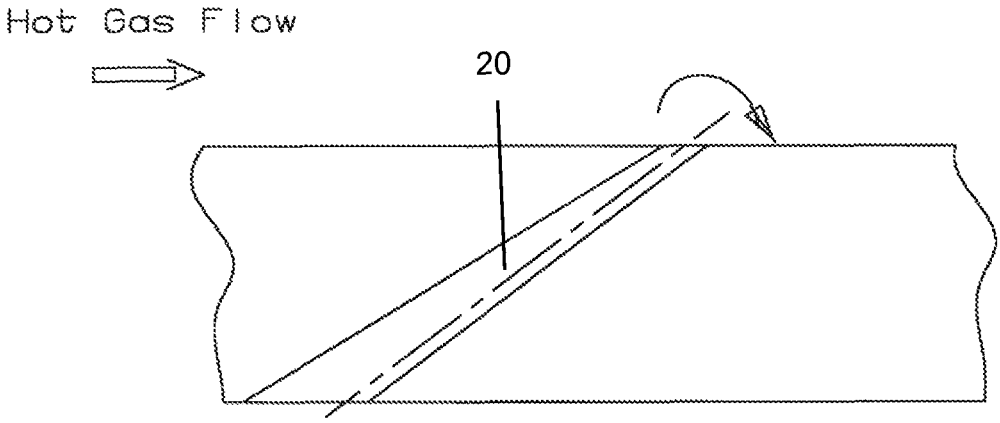
FIG. 19 shows a divergent and convergent film hole of the present invention with the upstream wall slanted.

FIG. 17 shows an electrode 30 pushed into a metal surface to form the film hole. With the electrode 30 pushed into the metal surface far enough, the electrode 30 is then pivoted up to 15 degrees from the film hole axis to one side to form the divergent wall surface. In the FIG. 14 embodiment, the electrode is rotated counter-clockwise so that the bottom surface of the electrode 30 is pushed down. FIG. 18 shows the first embodiment of the convergent divergent film cooling hole with the downstream wall forming the convergent section. FIG. 19 shows a second embodiment in which the upstream wall forms the convergent section. This is formed by pivoting the electrode clockwise.

The convergent and divergent film cooling hole of the present invention will allow for radial diffusion of the streamwise oriented flow to combine both aspects of radial and streamwise straight film cooling holes. The thin convergent and divergent diffusion shaped film cooling hole includes a parallel flow section at an inlet section followed the convergent section on the downstream side wall in the streamwise flow direction. The convergent downstream wall will create an elongation for the film cooling slot in a spanwise direction. This transforms the cooling slot from a conical shape to a thin elongated shape at the exit opening onto the airfoil surface.

Figure 1:
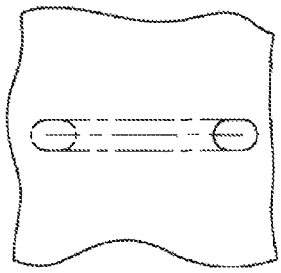
Fig 1 Prior Art
FIGS. 1 through 7 shows various views of a prior art straight film cooling hole.
Figure 2:
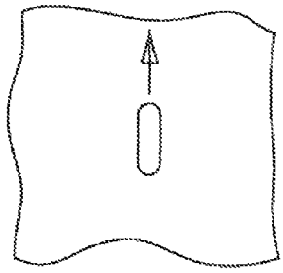
Fig 2 Prior Art
Figure 3:
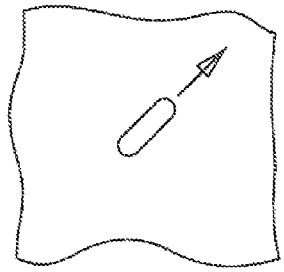
Fig 3 Prior Art
Figure 4:
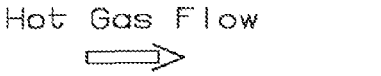
Fig 4 Prior Art
Figure 5:
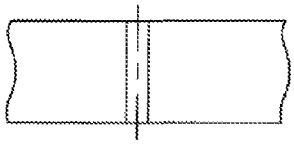
Fig 5 Prior Art
Figure 6:
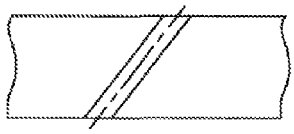
Fig 6 Prior Art
Figure 7:
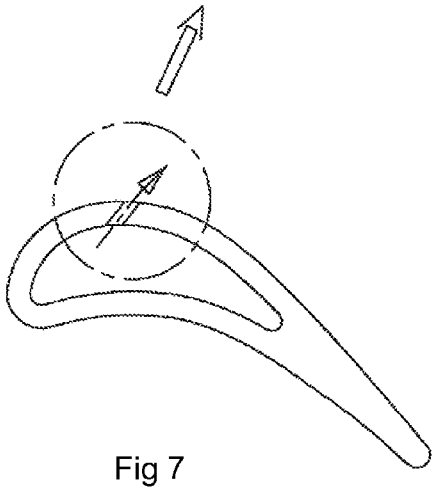
Fig 7 Prior Art
Figure 11:
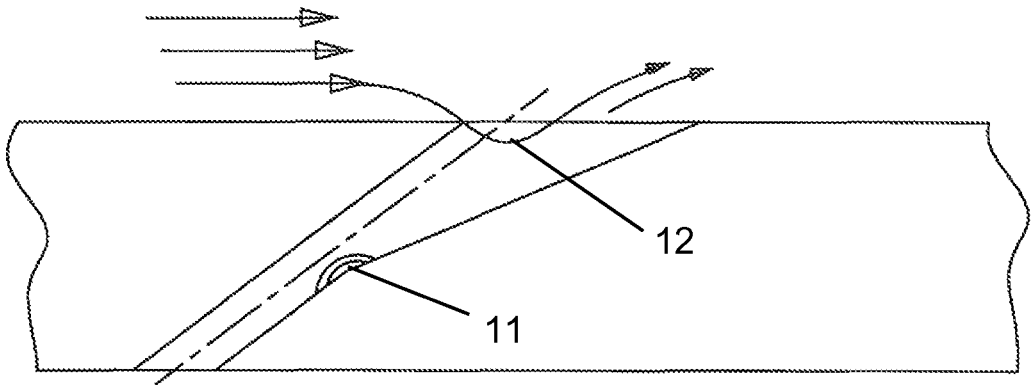
Fig 11 Prior Art
FIG. 11 shows a cross section view of the FIG. 8 film hole with a hot gas flow path over the hole.

The divergent side walls create a diffusion of the cooling air in the streamwise flow direction and further elongates the film cooling slot exit opening. This will enhance the spread of the cooling air flow on the airfoil surface resulting in a better film coverage on the airfoil surface than the prior art film holes by ejecting the cooling air at a much lower angle to the airfoil surface. This will minimize shear mixing between the cooling air layers and the hot gas stream resulting in a longer lasting film layer and better film cooling at a higher effective level on the airfoil surface. also, the thinner opening of the exit hole on the airfoil surface will eliminate the hot gas entrainment problem discussed above with FIG. 11, and the convergent wall will eliminate the internal flow separation issue than arises with the prior art 10×10×10 diffusion film cooling hole also described in FIG. 11.

The convergent and divergent film cooling hole can be formed by the use of electric discharge machining (EDM) process. A single point electrode with a two-dimensional shape (not counting the thickness) or with multiple electrodes formed on one holder can be used for the formation of the hole. The expansion angle of the film hole can be from around 15 degrees to around 25 degrees.

The convergent and divergent film cooling hole forms an expansion in a radial direction and a convergent in the streamwise direction. Hot gas ingestion and internal flow separation in the prior art film cooling holes is eliminated. Coolant penetration into the gas path is minimized, yielding a good buildup of the coolant sub-boundary layer next to the airfoil surface, a lower aerodynamic mixing loss due to low angle of cooling air discharge, a better film coverage in the spanwise direction and a high film effectiveness for a longer distance downstream of the film exit slot. The end results of both benefits produce a better film cooling effectiveness level for the turbine airfoil.

I claim the following:

1. A film cooling hole for an air cooled turbine airfoil comprising:

an inlet section;

a diffusion section downstream from the inlet section;

the diffusion section having both a divergent section and a convergent section;

the convergent section having flat walls; and, a thin exit slot opening onto a surface of the airfoil.

2. The film cooling hole of claim 1, and further comprising:

the diffusion section is divergent on two side walls and convergent on either an upstream wall or a downstream wall.

3. The film cooling hole of claim 2, and further comprising:

the divergent side walls have an expansion of from 15 to 25 degrees.

4. The film cooling hole of claim 2, and further comprising:

the convergent wall is slanted at an angle of up to 15 degrees.

5. The film cooling hole of claim 2, and further comprising:

the thin exit slot has a long side in a direction perpendicular to a streamwise direction of a hot gas flow over the film cooling hole.

6. A process for forming a film cooling hole, the film cooling hole having a diffusion section with a divergent wall and a convergent wall, the process comprising the steps of:

pushing an electrode into a metal surface of an airfoil where a film cooling hole is to be formed to form the divergent wall;

rotating the electrode in one direction to form the convergent wall; and, pulling the electrode out from the metal surface.

7. The process for forming a film cooling hole of claim 6, and further comprising the step of:

rotating the electrode in a counter-clockwise direction up to 15 degrees.

8. The process for forming a film cooling hole of claim 6, and further comprising the step of:

rotating the electrode in a clockwise direction up to 15 degrees.

* * * * *